United States Patent [19]

Switzer et al.

[11] 4,182,207

[45] Jan. 8, 1980

[54] FOOD STACK LOADER

[75] Inventors: William K. Switzer; Roland W. Wagner, both of Cincinnati, Ohio

[73] Assignee: Chemetron Corporation, Chicago, Ill.

[21] Appl. No.: 873,177

[22] Filed: Jan. 30, 1978

[51] Int. Cl.[2] ..... B26D 4/44; B26D 7/06; B26D 7/24

[52] U.S. Cl. ..... 83/61; 83/79; 83/90; 83/147; 83/149; 83/154; 83/155.1; 83/156; 83/162; 83/167

[58] Field of Search ..... 83/61, 79, 90, 147, 83/149, 154, 155.1, 156, 162, 167; 214/1 B, 1 BC, 1 BD; 53/35, 52, 247

[56] References Cited

U.S. PATENT DOCUMENTS

| | | | |
|---|---|---|---|
| 1,556,078 | 10/1925 | Clymer | 214/1 BC |
| 3,180,066 | 4/1965 | Mahaffy et al. | 53/52 |
| 3,965,783 | 6/1976 | Müller et al. | 83/155.1 X |
| 4,026,421 | 5/1977 | Lotz | 83/79 X |

*Primary Examiner*—Frank T. Yost
*Attorney, Agent, or Firm*—Vincent G. Gioia

[57] ABSTRACT

A machine for picking up stacks of sliced food obtained from a slicer and loading the stacks into cavities of a packager which then encloses same. The machine includes a transmission driven in synchronism with the packager that pivots a placer having spring closed doors for stack support from a load position wherein a ram loads each cavity, to an upper pick up position on an inclined, transmission driven, conveyor having suitable stops. The stops retract, and the conveyor pivots downwardly, as the placer moves the stacks to the load position without interference with the stops and the conveyor. Suitable feed conveyors load an escapement for the stacks for the sequential movement of the stacks to the stop positions. A control system is provided to regulate the flow of stacks from the slicer to the loader for continuous loader operation if desired.

8 Claims, 28 Drawing Figures

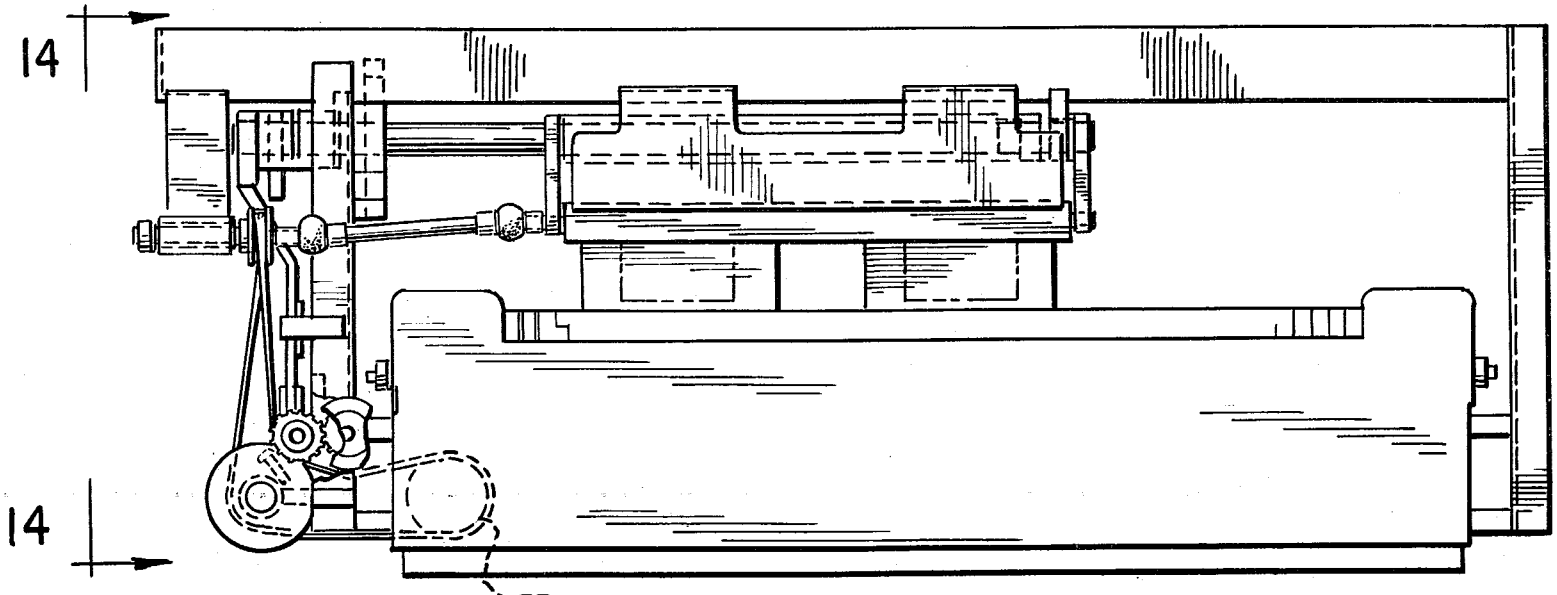
FIG. 12
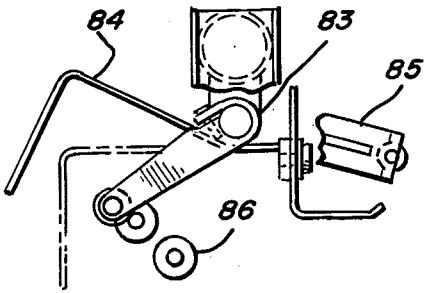
FIG. 11
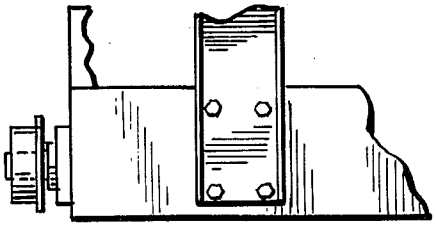
FIG. 14
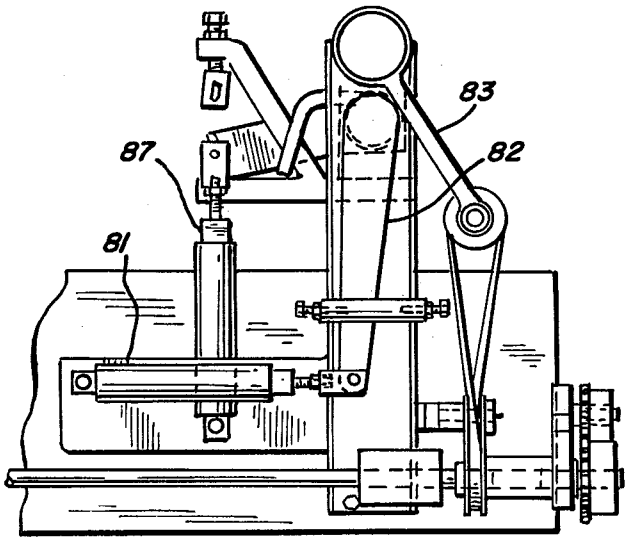

FOOD STACK LOADER

BACKGROUND OF THE INVENTION

1. Field of the Invention

This invention pertains generally to food stack loaders.

2. Description of the Prior Art

A conventional food stack loader may utilize one or more placers each of which includes at least one gripping device that must open to enclose a stack, close to grip, with the placer then being lifted vertically prior to transport to a loading position for vertical stack placement into a packager cavity. This loader requires considerable structure to achieve the detailed functions. Further, the gripping action may deform the food stacks, which may be sliced luncheon meat or the like.

SUMMARY OF THE INVENTION

Applicants, as a consequence, designed a loader that largely avoids the extensive structure and disadvantages of the prior art. Generally, Applicants dispense with the grippers and substitute therefor a transmission driven placer equipped with a pair of spring closed doors. The placer may have one or more pairs of doors as desired. Preferably, two or more pairs of laterally spaced doors for each placer are utilized. Additional longitudinally spaced pairs of doors for each placer can also be utilized. A ram mounted on the placer forces a stack past a pair of doors into a packager cavity during the loading operation. For pick-up, Applicants provide an inclined transmission driven conveyor that has a pair of laterally spaced stops. As the placer is pivoted on an arc from a lower load position to an upper pick up position, each stack is deposited on a pair of spring closed doors and the conveyor continues to pivot downwardly when inclined conveyor pivots to a slight downward position. As the placer pivots downwardly to the load position the stops retract and the conveyor pivots downwardly to avoid contact with the stacks. For accurate and continuous operation, an escapement is desired to provide one stack per stop. The escapement in turn requires suitable feed conveyors to load same. A control system is provided to regulate the flow of stacks from the slicer to the loader for a continuous operation.

Applicants' design provides a vastly simplified structure to efficiently achieve their desired result without damage to the stacks.

It is therefore, an object of this invention to provide a new and improved food stack loader.

Another object is to provide a food loader that utilizes less structure.

Another object is to provide a food stack loader that regulates the flow of stacks from the slicer to the loader for continuous loader operation.

BRIEF DESCRIPTION OF THE DRAWINGS

FIG. 11 is an enlarged elevational view of the escapement similar to that shown in FIG. 1 and located adjacent the packager end of the loader;

FIG. 12 is an end view of the escapement looking from the packager end;

FIG. 14 is an elevational view taken along line 14 — 14 of FIG. 12;

DESCRIPTION OF THE PREFERRED EMBODIMENT

Figure 1:
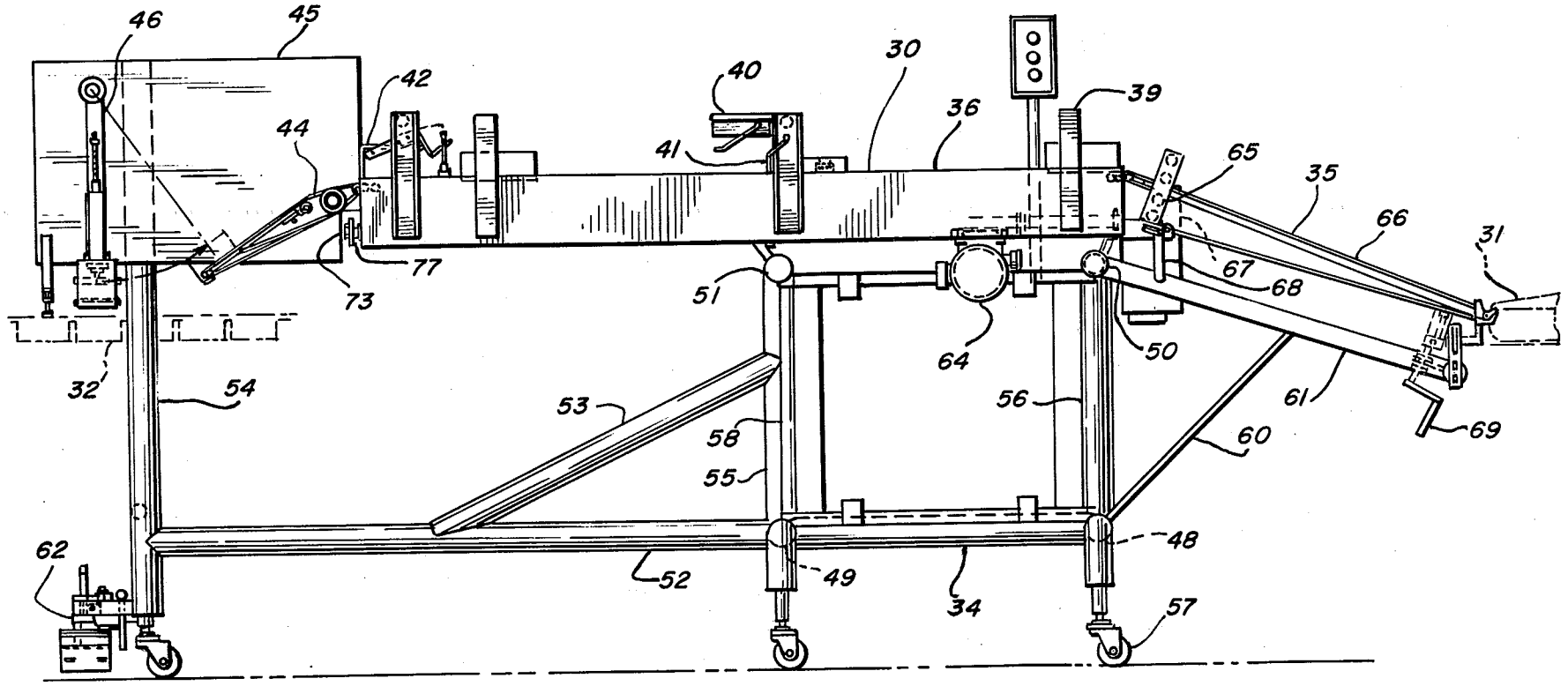
FIG. 1 is a side elevation (partially schematic) of the food stack loader with the discharge of the slicer shown on the right side of the loader in broken lines and the intake of the packager shown on the left side in broken lines.
Figure 2:
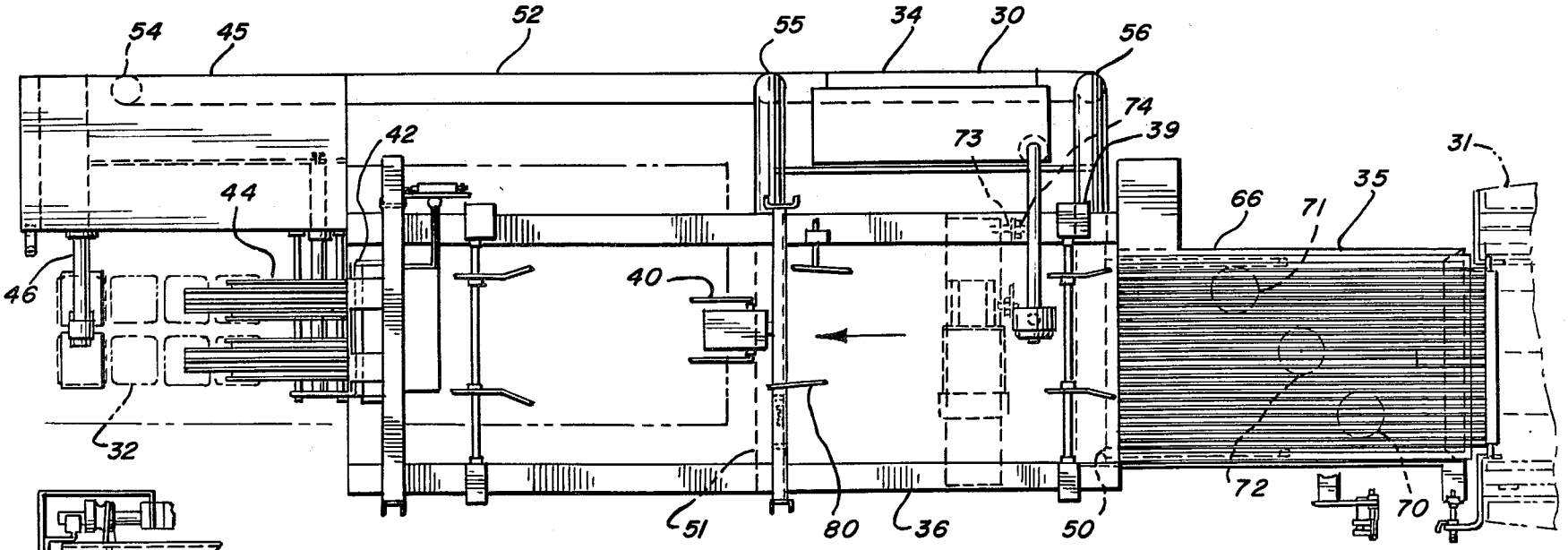
FIG. 2 is a plan view of the loader.
Figure 2A:
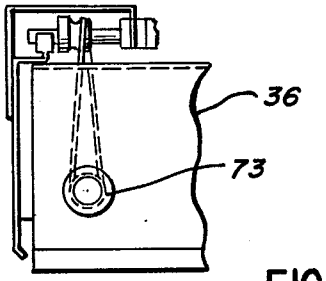
FIG. 2*a* is an end elevational view of the drive of the main or surge conveyor.
Figure 3:
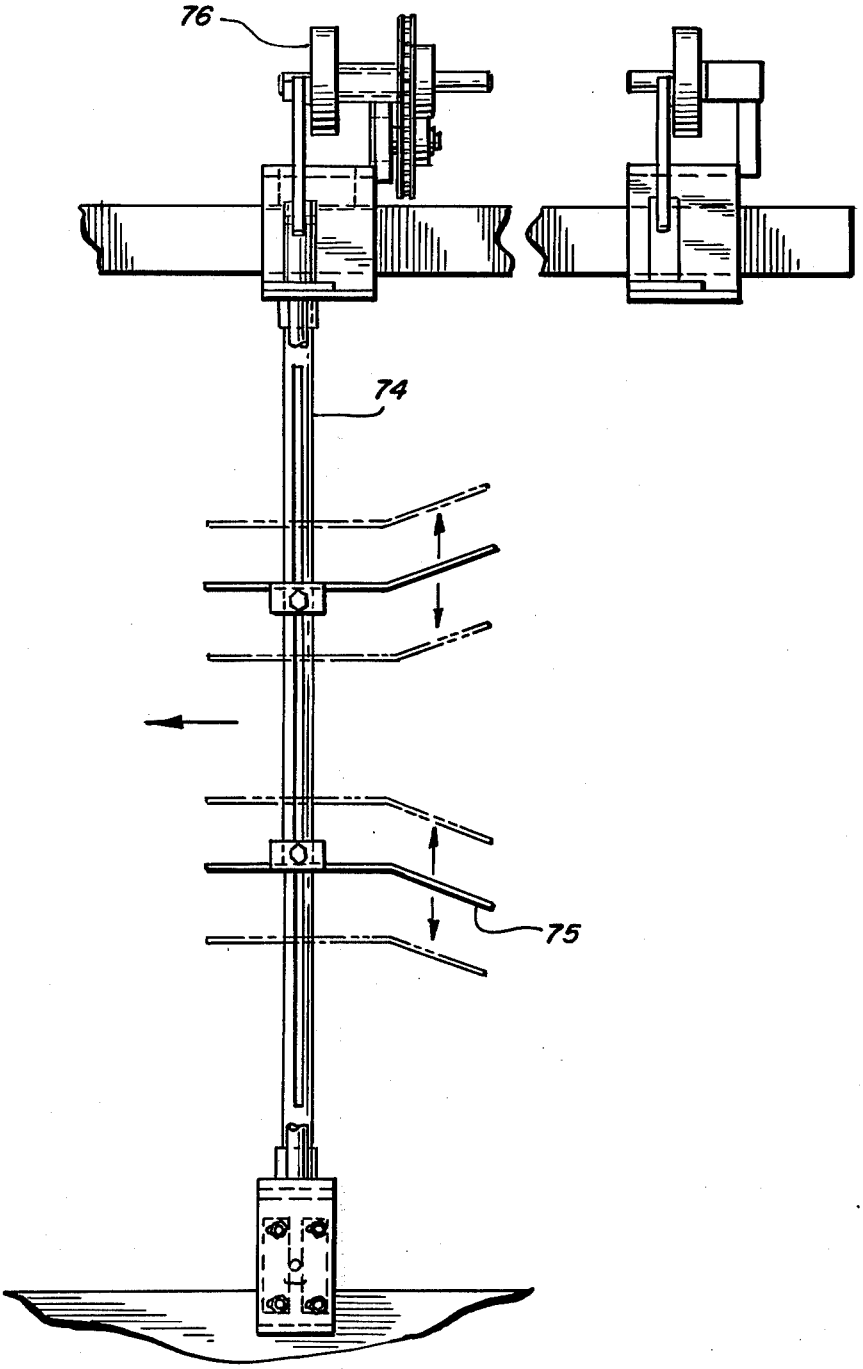
FIG. 3 is an enlarged plan view of a guide assembly shown in FIG. 2.

Referring to FIGS. 1 and 2, 30 indicates a food stack loader for receiving stacks of sliced food from a slicer 31 and loading each stack into a cavity of a packager 32 for the packaging of same. Loader 30 includes a base assembly 34, an infeed conveyor 35 located on the intake end of the machine, a surge conveyor 36, a reject conveyor (not shown), a pair of guide assemblies 39, a sensor wand assembly 40, a stop gate assembly 41, an escapement assembly 42, an inclined conveyor 44, a transmission box 45 and a placer assembly 46 located on the discharge end of the machine.

Base assembly 34, as shown best in FIGS. 1 and 2, includes laterally extending lower braces 48 and 49 and upper braces 50 and 51. Also included is longitudinally extending lower brace 52 located on the rear or drive side of the machine that connects with vertical post 54, center post 55 and post 56 and brace 53. Height adjustable casters 57 support base assembly on the floor via vertical, integral extensions of braces 49 and 50 on the tending side and on the drive side via post 56 and post 55. Reinforcement 58 provide stiffening to the base assembly while reinforcements 60 and 61 support infeed conveyor 35. Conventional docking device 62 connects loader 30 to packager 32.

Infeed conveyor 35 as shown in FIGS. 1 and 2 transfers stacks of preferably sliced meat from slicer 31 which may be of the type disclosed in U.S. Pat. No. 3,280,428 entitled Method and Apparatus For Producing Weight Controlled Groups Of Sliced Products and issued on June 28, 1974 and assigned to assignee of subject application. Conveyor 35 is driven off gear motor 64 mounted on base assembly 34 by a suitable support plate via a conventional chain sprocket. Via a belt, drive roll 65 drives a plurality of belts 66 of conveyor 35 each carried by individual rollers. Air clutch 67 provides for the intermittent operation of the drive roll 65. Rod 68 provides a tightening effect to the conveyor belts, while screw device 69 allows elevational adjustment of the conveyor and the latching of same on the bracket attached to the slicer. A reject conveyor (not shown) may be provided on the tending side of the machine and in conjunction with conveyor 35 and a deflector (not shown) to deflect the separated stacks 70 adjacent the tending side toward the reject conveyor for manual correction. Stacks 71 and 72 move up the conveyor 35 where they then move on to surge conveyor 36. The arrow shows the direction of flow of stacks 71 and 72 to eventual deposit in longitudinally aligned cavities at the load end of the machine.

Surge conveyor 36 extends from the end of the loader adjacent the infeed conveyor 35 to the end of the escapement. Surge conveyor is a slip torque conveyor but of a different variety compared to conveyor 35. Specifically, surge conveyor 36 is of the type generally described in U.S. Pat. No. 3,951,255 dated Apr. 20, 1976 to Shuttleworth. Essentially a single drive shaft extending the length of the conveyor support is utilized and by individual plastic belts driven by the shaft, the closely fitting transversely extending shafts having a plurality of rollers for conveying the product are individually driven. Since the rollers are loosely mounted on their shafts, any resistance to the rollers by the stacks causes the low friction rollers to slip thus not endangering the stacks. This drive is shown best in view *2a*. The shaft 73 shown in FIG. 2 via sprocket 74 is driven from gear motor 64. The rollers of the surge conveyor extend the length of the shafts which are located closely together as shown in FIG. 1 and extend to adjacent the upper end of conveyor 35. Referring to FIG. *2a*, which is an end view of the discharge end of conveyor 36, the individual drive from drive shaft 73 is transmitted via a plastic belt to each shaft having a plurality of rollers mounted on the shaft which can slide on the shaft if resistance by the stack on the roller is encountered. Preferably the belt is driven at 60 ft. per minute which then takes 0.42 seconds for a 5 inch stack shown to pass under the wand assembly 40.

Figure 4:
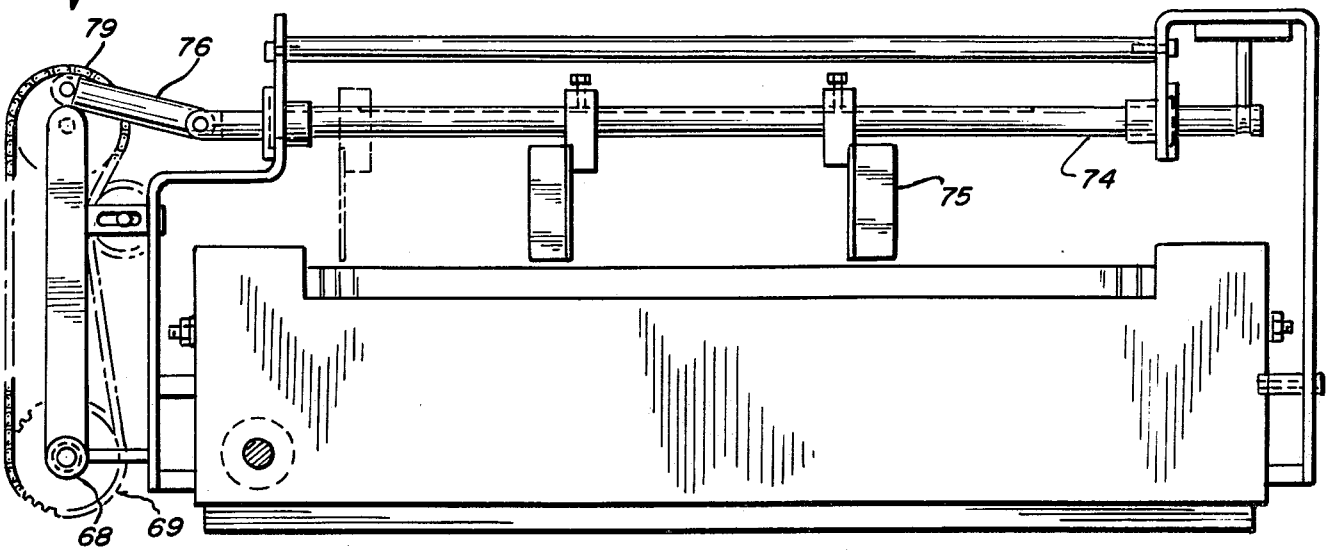
FIG. 4 is an end elevational view looking from the packager end of the loader of the guide assembly of FIG. 3.
Figure 5:
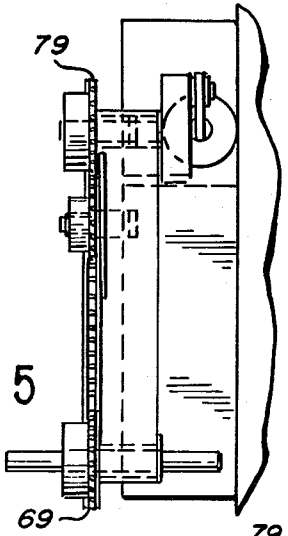
FIG. 5 is a view taken along line 5 — 5 of FIG. 4.

Guide assemblies 39, two of which are shown, are mounted on the side supports of surge conveyor 36 and extend thereover. The guides are reciprocated as shown to properly position the stacks before the wand and escapement. Referring to FIGS. 1 and 2 and FIGS. 3, 4 and 5, in particular each assembly includes a shaft 74 on which are adjustably mounted, via screw collars, deflectors 75. The screw collars allow the positioning as desired on the shaft for the stacks transfered. As shown in FIG. 4 crank arrangement 76 reciprocates shaft 74 in suitable bearings as noted. The reciprocation is achieved by a drive via a sprocket and chain off gear motor 64 with the sprocket 77 being located at the end of the surge conveyor adjacent the escapement. See FIG. 1. Sprocket 77 drives longitudinally extending shaft 68 and thus upper sprocket 79. Both guide assemblies shown are ultimately driven off shaft 68. Auxiliary guide assembly 80 shown in FIG. 2 is not reciprocatable as shown.

Located adjacent the loading side of loader 30 is escapement assembly 42. Escapement assembly is shown on a reduced scale in FIGS. 1 and 2 and on an enlarged scale on FIGS. 11, 12, 13 and 14. The purpose of the escapement is to allow two stacks when they are abutting the gate in lateral fashion to move to the inclined conveyor upon release of the escapement, but no more then the two stacks before the escapement closes. To aid in the removal of same adjacent the gate as the escapement opens, a feed roll normally driven moves into position to contact the stacks and drive same faster then the action provided by the slowly feeding surge conveyor 36. Escapement 42 includes air cylinder 81 which via lever 82 rotates shaft 83 and therefore escapement gate 84 to an open position or a closed as is apparent as shown in FIG. 11. Also rotatably mounted to shaft 83 is lever 85 of feed roll 86 which is lifted upwardly or downwardly by vertical air cylinder 87 to contact the stack. Feed roll 86 is constantly driven and, when contacting this stack and will drive same to incline conveyor 44. The drive for the feed roll is also taken off shaft 73 extending through surge conveyor 36. Escapement gate as shown best in FIG. 11 is denominated 84 and extends across both laterally spaced stacks. Shaft 73 as shown in FIG. 12 via a sprocket drives the sprocket of the feed roll drive through a belt. Of course the action of the escapement opening and the pivoting of the feed roll to feed must be coordinated so that both work at the same time and do not work with the escapement closed.

Figure 6:
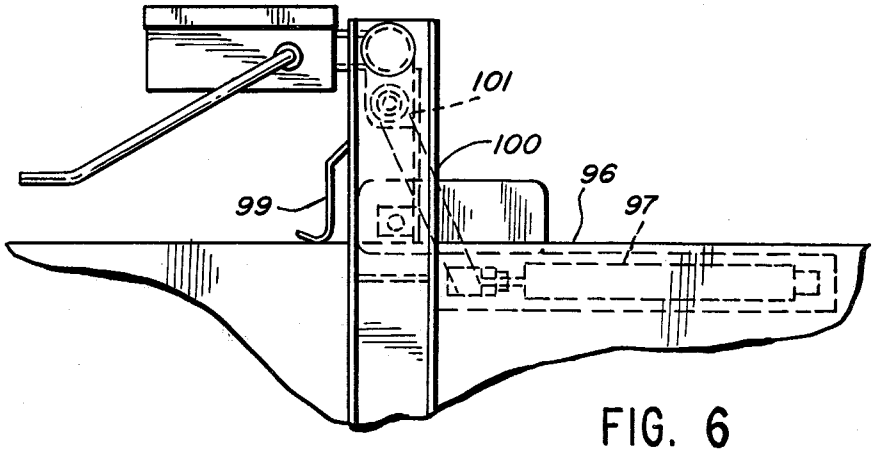
FIG. 6 is an enlarged elevational view of the sensing wand and the stop gate as similarly shown in FIG. 1.
Figure 8:
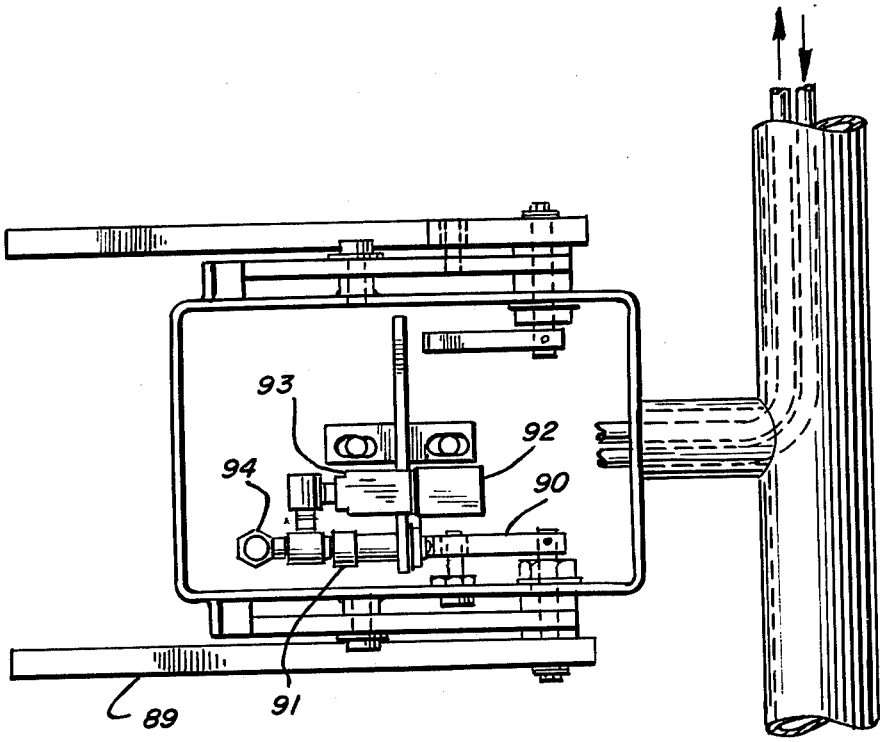
FIG. 8 is a plan view of the sensing wand.
Figure 7:
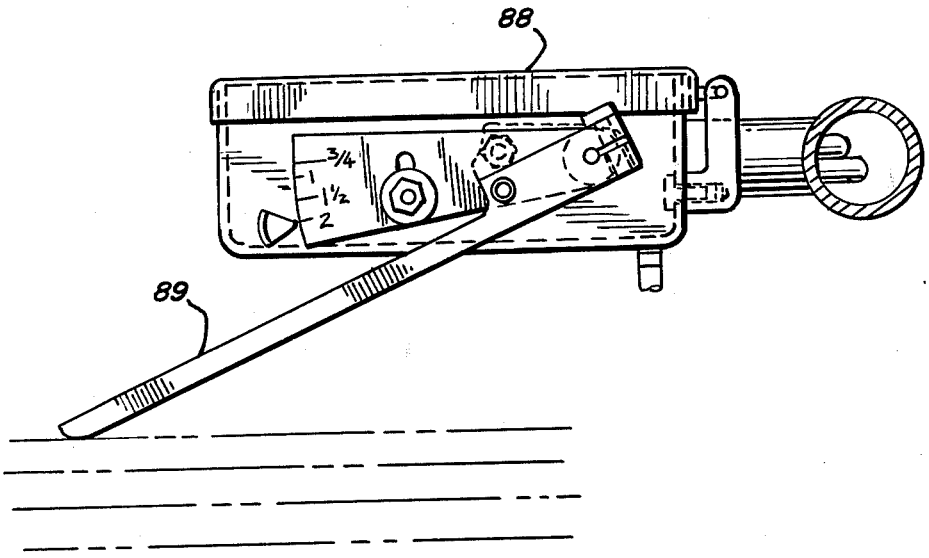
FIG. 7 is an enlarged side view of the sensing wand.
Figure 10:
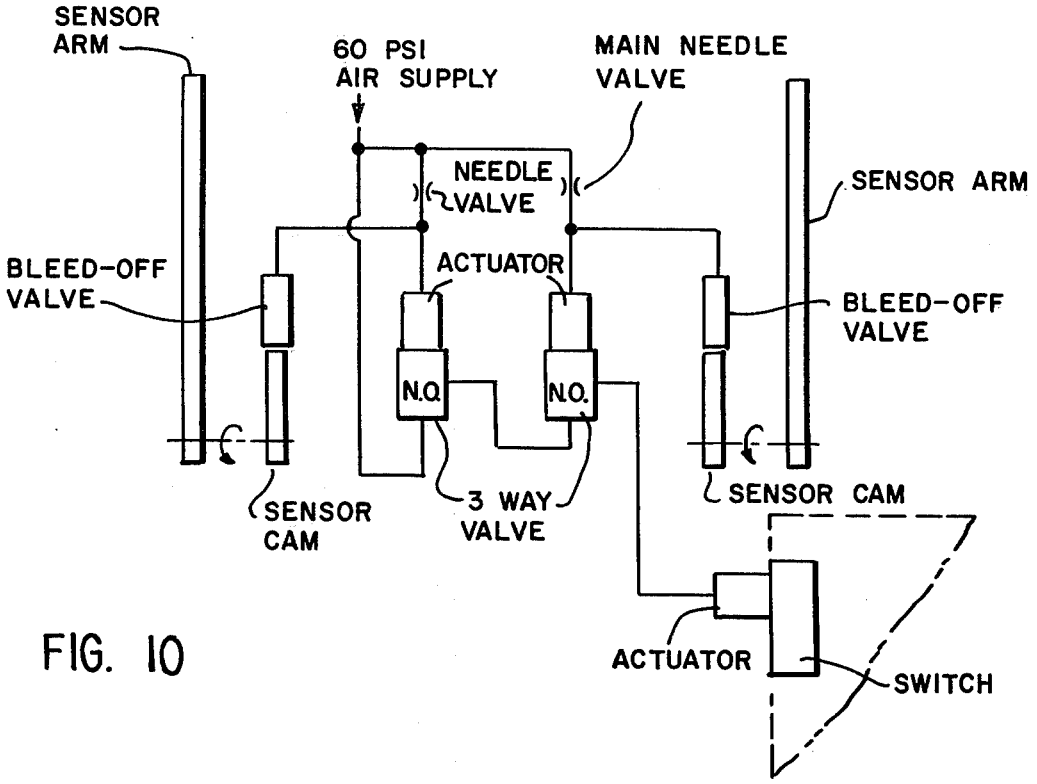
FIG. 10 is a view of the sensing wand pneumatic system.
Figure 9:
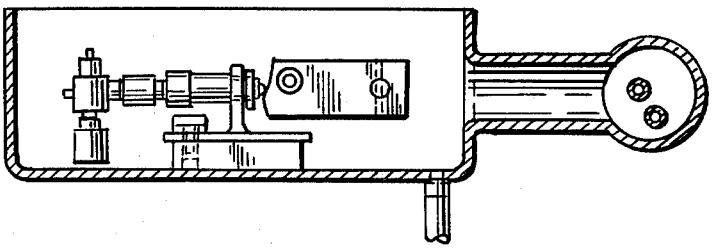
FIG. 9 is a sectional elevational view of the wand of FIG. 8.
Figure 13:
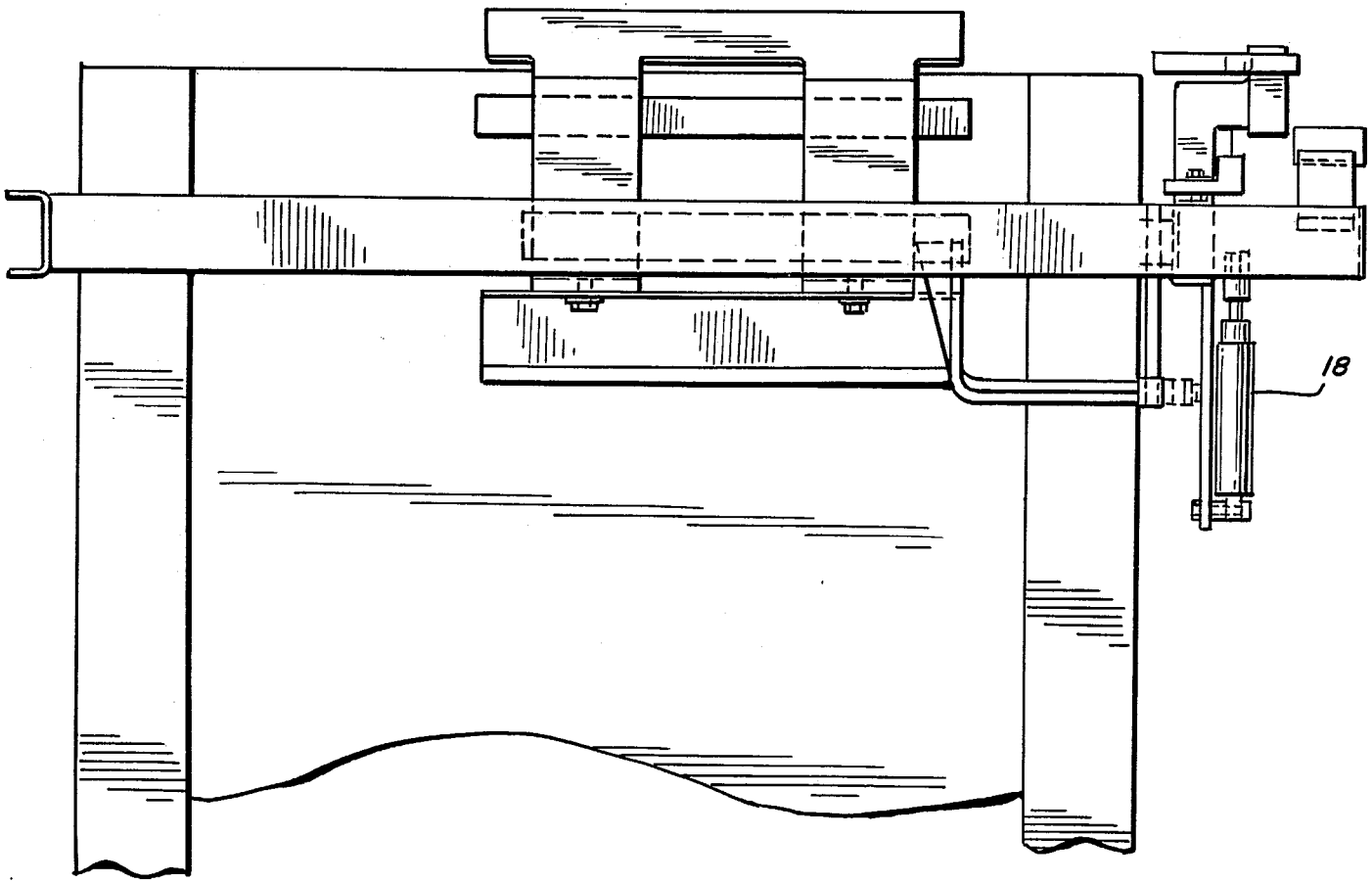
FIG. 13 is a plan view of the escapement.

Also related to the escapement operation is the sensing wand and stop gate assembly which are shown together in FIG. 6 which is an enlarged version of FIG. 1. Though somewhat distinct they are related and will be treated at the same time. The sensor assembly 88 has a pair of wands (adjustable in height) between ¾ to preferably 2 inches of stack height which is shown particularly in FIG. 7 and also in FIGS. 8 and 9. Although two wands are shown and are connected in parallel for operation, (see FIG. 10) one wand for one line of stacks would suffice. Only one wand and its related items will be described. Essentially the purpose of the wands is to sense a condition in which some 8 stacks are lined up in abutting relationship before the excapement. In this case, the stacks are stationary, thus after 1 second, a signal will be sent to activate a pneumatic switch which then energizes an electric circuit which will be later discussed in detail. In this case, the loader cannot keep up with the output of the slicer. Where one stack moves by the wand in 0.42 seconds time, this does not trip the switch and the loader can handle this flow. The sensor assembly 88 has a wand 89 for each line of stacks which via lever 90 actuates commercial cam operated bleed off valve 91 that is connected with a pilot actuator 92 connected to a N.O. 3 was valve 93. The other wand is connected in parallel and has a similar circuit. Needle valve 94 is also connected to the pilot actuator so that an open valve condition of the bleed off valve of 1 second will cause the parallel valves to activate the pressure switch or IPS of FIG. 26. This will develop the signal to the electrical circuit to close down the infeed to the loader until the wand or wands are again free of stacks for the 1 second period. Thus the loader can reduce its back load of stacks to be loaded.

Associated with the sensor assembly 88 is the stop gate assembly 96 located adjacent thereto. Stop gate assembly 96 is shown best in FIG. 6 but is also shown schematically in FIG. 1 and includes an air cylinder 97 located on the machine tending side whose purpose is to open and close the gate to control the flow of stacks depending upon the sensing assembly 88. Stop gate assembly 96 includes gate 99 and lever 100 and shaft 101. The function of the stop gate assembly will be discussed with the pneumatic and electrical circuits to explain its use in regulating stack flow to the loader.

Figure 19:
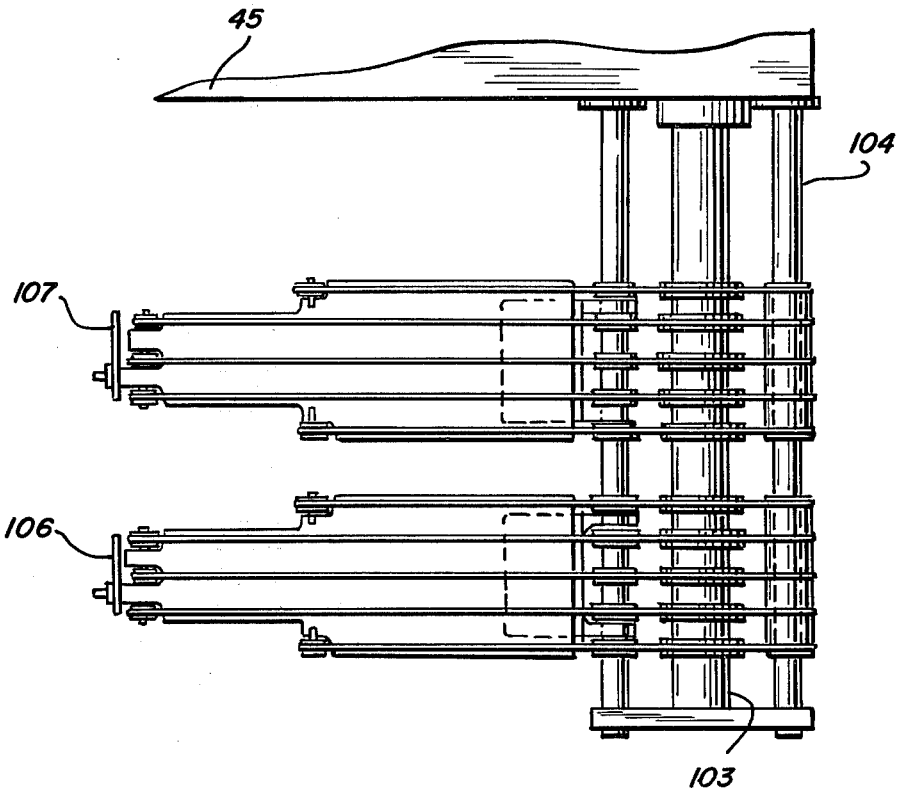
FIG. 19 is a plan view of the inclined conveyor of FIG. 18.
Figure 18:
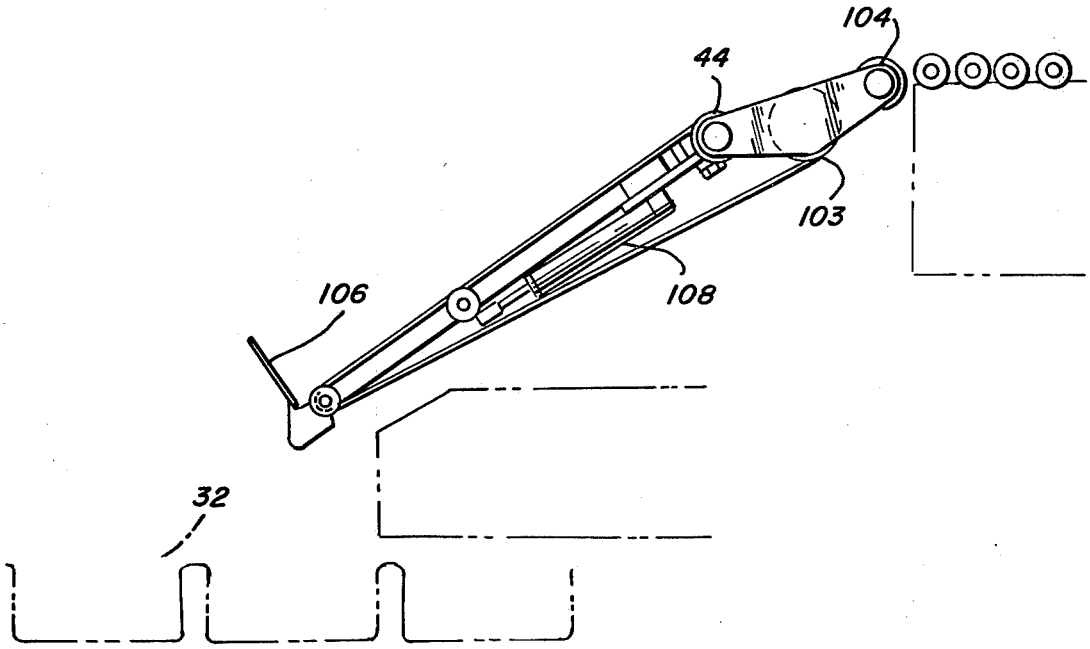
FIG. 18 is an enlarged elevation of the inclined conveyor as shown in FIG. 1 which is located at the packager end.
Figure 22:
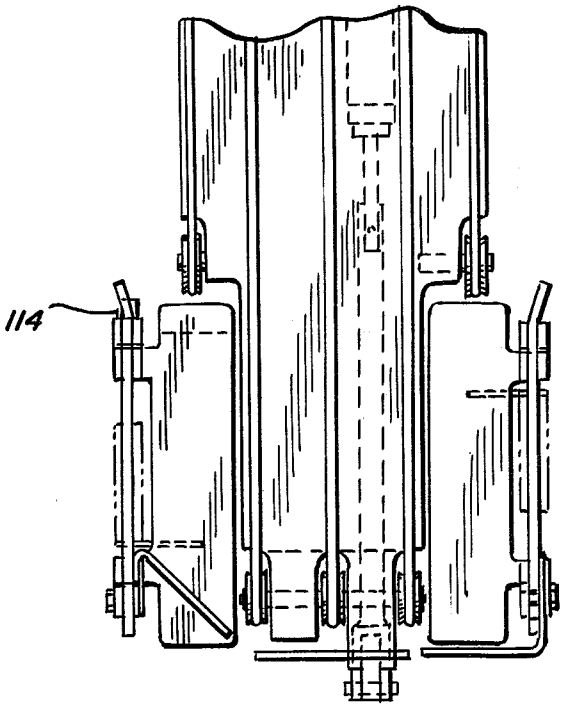
FIG. 22 is a plan view of a portion of the placer in relation to the inclined conveyor.
Figure 20:
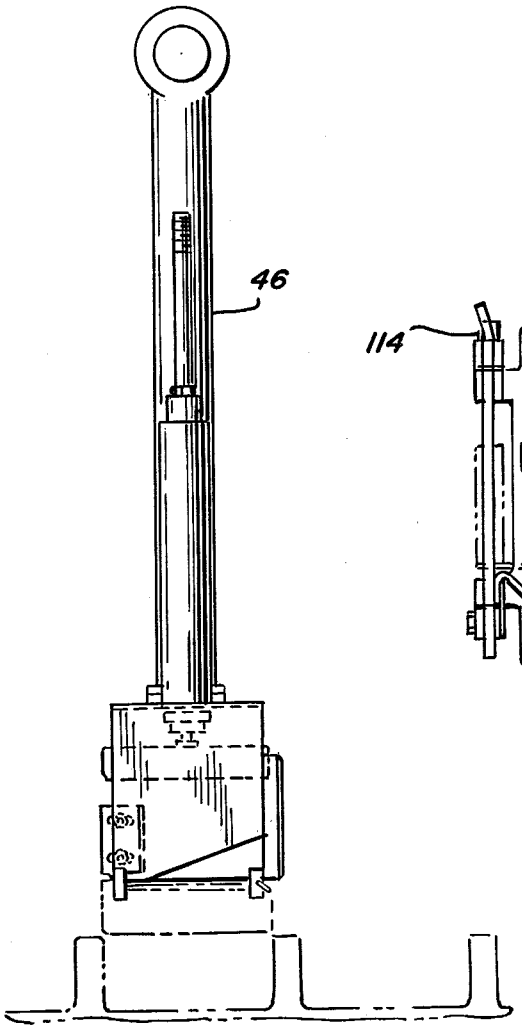
FIG. 20 is an enlarged view of the placer of the loader as shown in FIG. 1.
Figure 21:
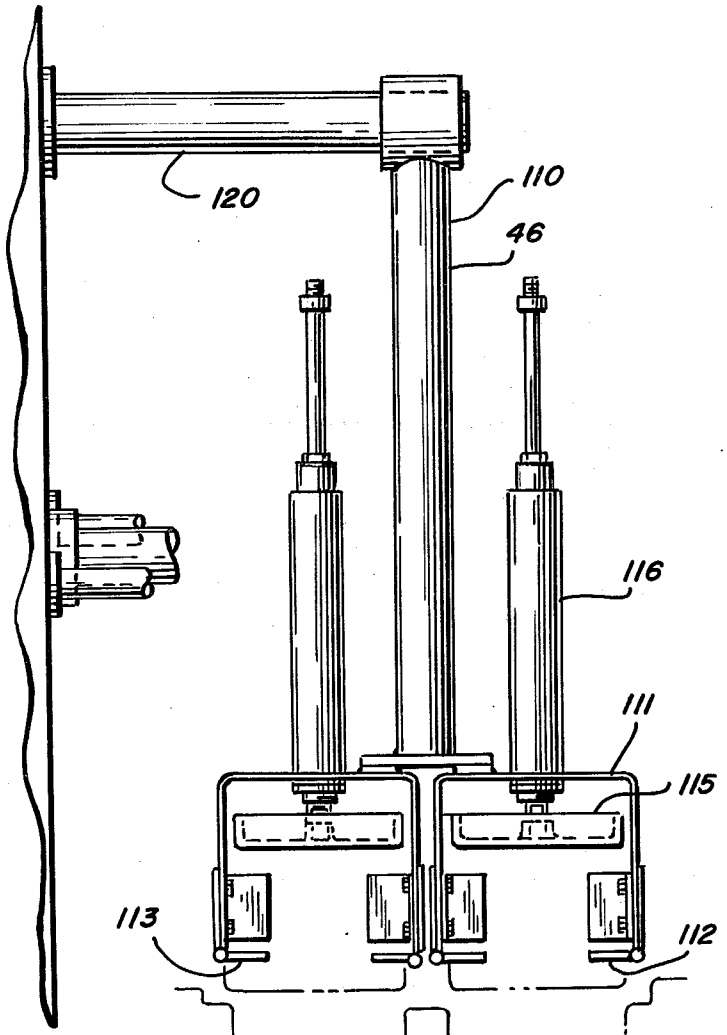
FIG. 21 is an end view of the placer looking from the packager end.

Adjacent the packager end of the loader is the inclined conveyor assembly 44. Inclined conveyor assembly 44 is shown best in FIGS. 1, 2, 18 and 19. Assembly 44 is supported via stationary support shaft 103 which is a part of gear box or transmission assembly 45. Assembly 44 is driven by shaft 104 which is driven in turn by a sprocket located in the gear box 45. Assembly 44 is located in a downwardly inclined position extending toward the packager 32. Double acting air cylinder 105 (see FIGS. 15 and 16) located to the rear of the gear box pivots the conveyor about support shaft 103 to an upward or lower position. Conveyor 44 also has mounted thereon lower stops 106 and 107 which are shown in FIG. 18 in the up position to hold a stack per stop ready for pickup. Air cylinders (double acting) 108 and 109, which are connected in parallel, move stops 106 and 107 between retracted and up positions as required. As shown best in FIGS. 19 and 22, conveyor 44 is so spaced into two separate positions as to permit the spring closed doors of the placer assembly 46 to move therebetween. FIG. 22, in particular, shows the doors in relation to the conveyor for pick up of a stack whose sides would extend beyond the width of the conveyor end for pick up by the doors. Conveyor 44 is similar in structure to infeed conveyor 35 wherein belts move over rollers that are slidably mounted on the drive shaft to allow slippage relative to the shaft when the stacks restrain movement of the belts as when against stops 106 and 107. As mentioned previously, additional longitudinally spaced stops could be utilized if additional stack pickups per placer were desired. Of course, these stops would also have to be retractable. Suitable side guides also could be utilized with conveyor 44 and bottom trays (shown).

The placer assembly 46 of the loader is shown best in FIGS. 1, 2, 20, 21, and 22. Placer assembly 46 includes pick up arm 110 which is mounted for movement between a load and pick up position on gear box 45. Pick up arm 110 includes frame 111. Frame 111 supports 2 pairs of laterally extending doors 112 and 113. Spring 114 maintains each door in the closed position shown in FIG. 21. A ram 115 driven by double acting air cylinder 116 is mounted for use with each pair of doors and, when extended, will force the stack past the doors into the package cavity with the springs closing the doors when the cylinder retracts. As shown best in FIG. 1, placer assembly 46 will move from the lower load position aligned with a cavity to the upper pick up position to lift a stack per pair of doors off conveyor 46 at the pickup position for later placement in the packager at the load position.

Figure 15:
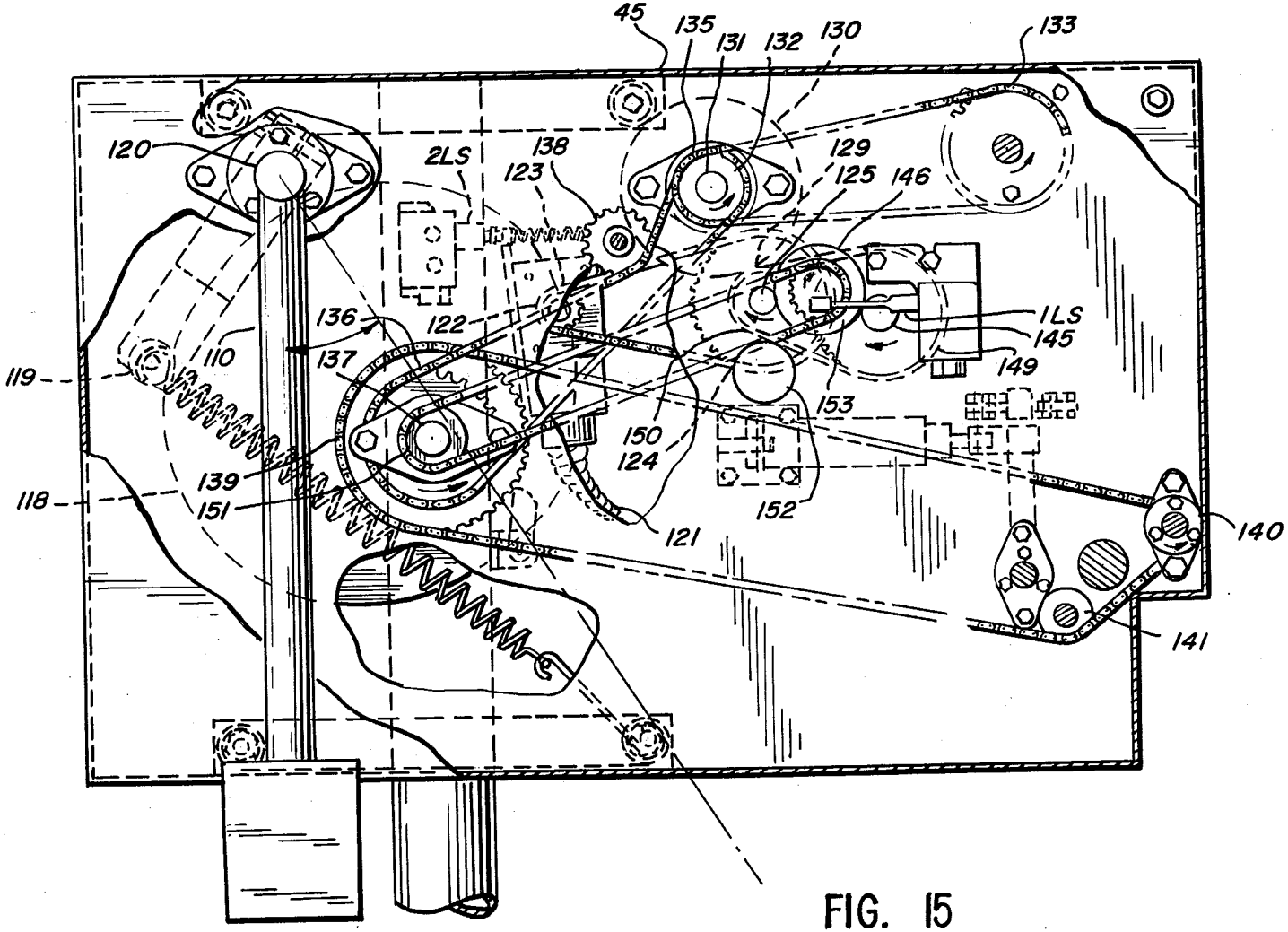
FIG. 15 is an enlarged side view (partially in section) of the transmission gear box of the loader (with the front cover cut away and in some instances the rear cover also) similar to that shown in FIG. 1.
Figure 16:
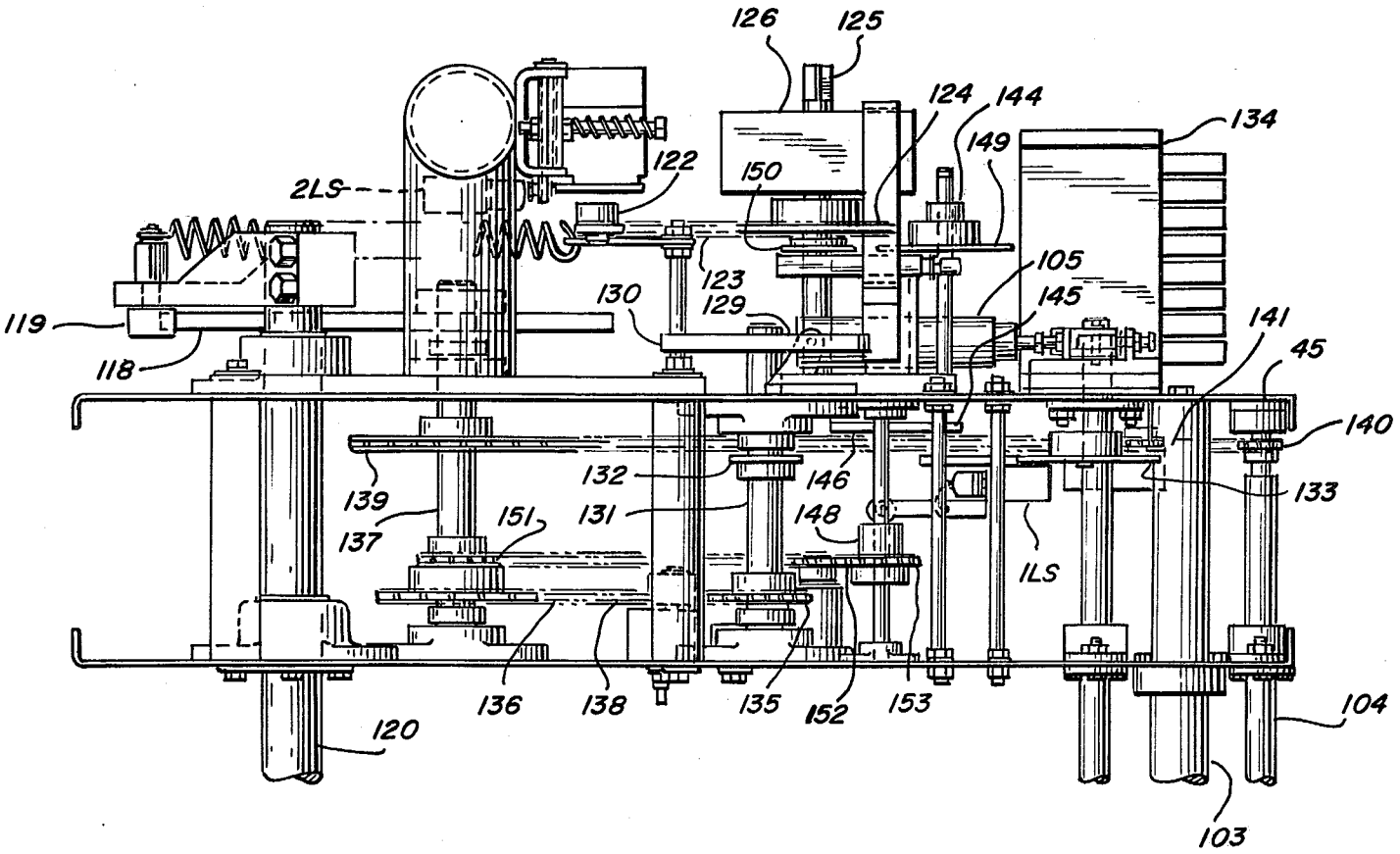
FIG. 16 is a plan view of the gear box with portions cut away.
Figure 17:
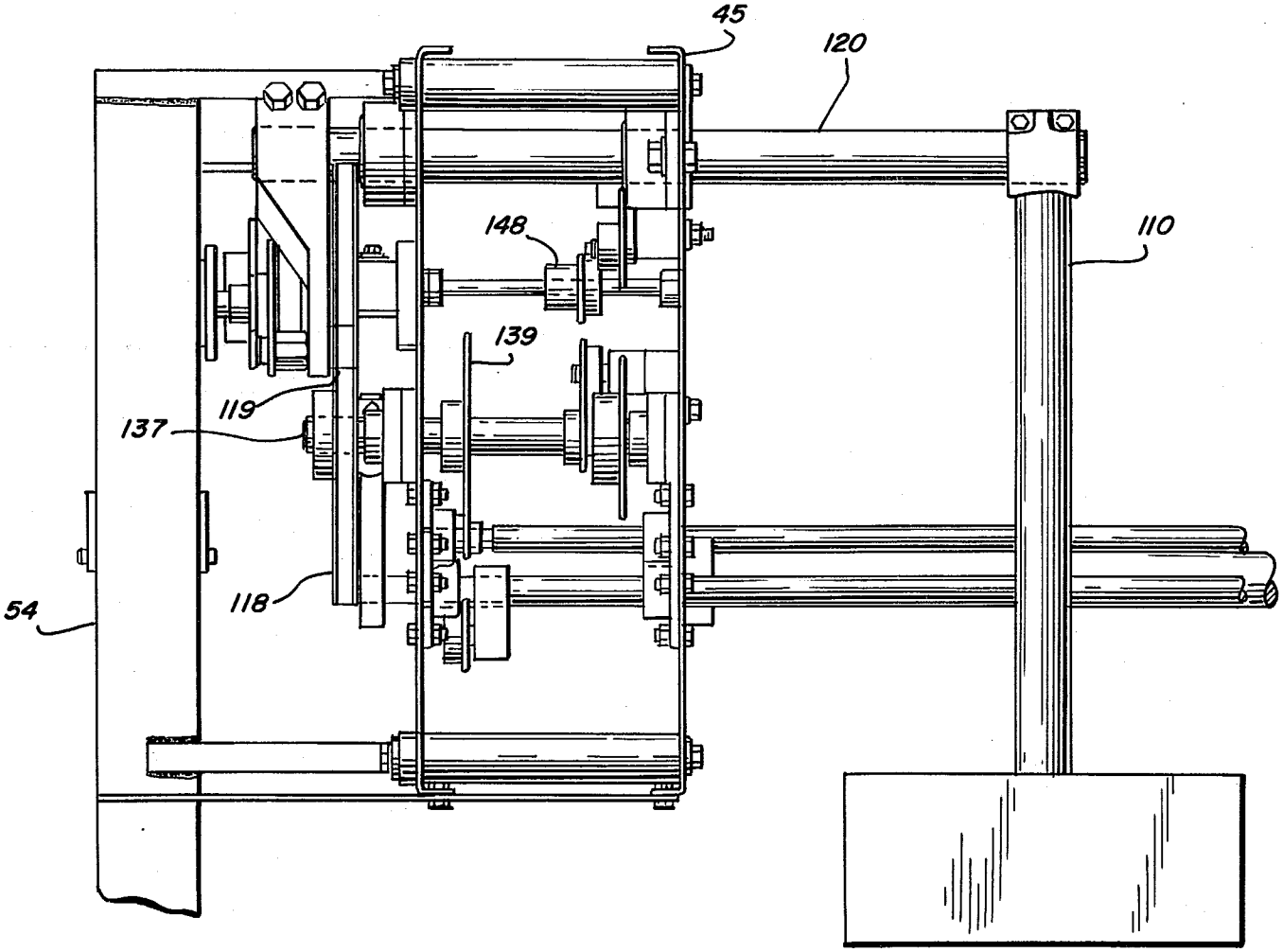
FIG. 17 is an end view looking from the packager of the gear box of FIG. 16.

Transmission or gear box 45 which accomplishes a good deal of the drive of the loader is shown in detail in FIGS. 15, 16 and 17. Gear box 45 includes primarily driven cam 118 and roller follower 119 connected to drive shaft 120 to actuate attached arm 110. Flexible drive shaft 121 connected to the packaging machine 32 drives sprocket 122 which via a chain 123 drives sprocket 124 mounted on shaft 125 having an electrical clutch 126. Any overload on chain 123 will trip a limit switch 2 LS to disengage clutch 126. Shaft 125 via spur gear 129 drives gear 130 on shaft 131. Shaft 131 via small sprocket 132 drives via a chain, sprocket 133 attached the shaft of pneumatic programmer 134 which via suitable cams actuates the various pneumatic elements in sequence as shown best in FIG. 23 and phase diagram FIG. 27. Large sprocket 135 on shaft 131 drives sprocket 136 located near the front of the gear box of cam shaft 137 having tightening sprocket 138. Rear sprocket 139 on the cam shaft drives sprocket 140 of the inclined conveyor 44 and related sprocket 141.

Inasmuch as the packager and loader must be synchronized and also because of the flexible drive shaft used, a conventional arrangement is utilized including limit switch ILS to achieve a proper phase relation. When not in its slot as shown in FIG. 16, the clutch will be deenergized. To place all elements in phase, the electric clutch is released, the packager is jogged until cavity stops index, the loader is hand worked via the end of shaft 125 shown until a mark on the cam lines up with the cam follower and the adjusting thimble 144 is then disengaged, rotated so that gear 145 will rotate to drive 146 gear and thus phasing sleeve 148 in regard to a slot 50 that the limit switch is positioned as shown in FIG. 16. Thimble 144 is then repositioned. Of the phasing assembly, sprocket 149 and sprocket 150 are related, and sprocket 151 of shaft 137, idler sprocket 152, and sprocket 153 and adjacent sleeve 148 are all in sequence with the limit switch ILS shown.

Figure 23:
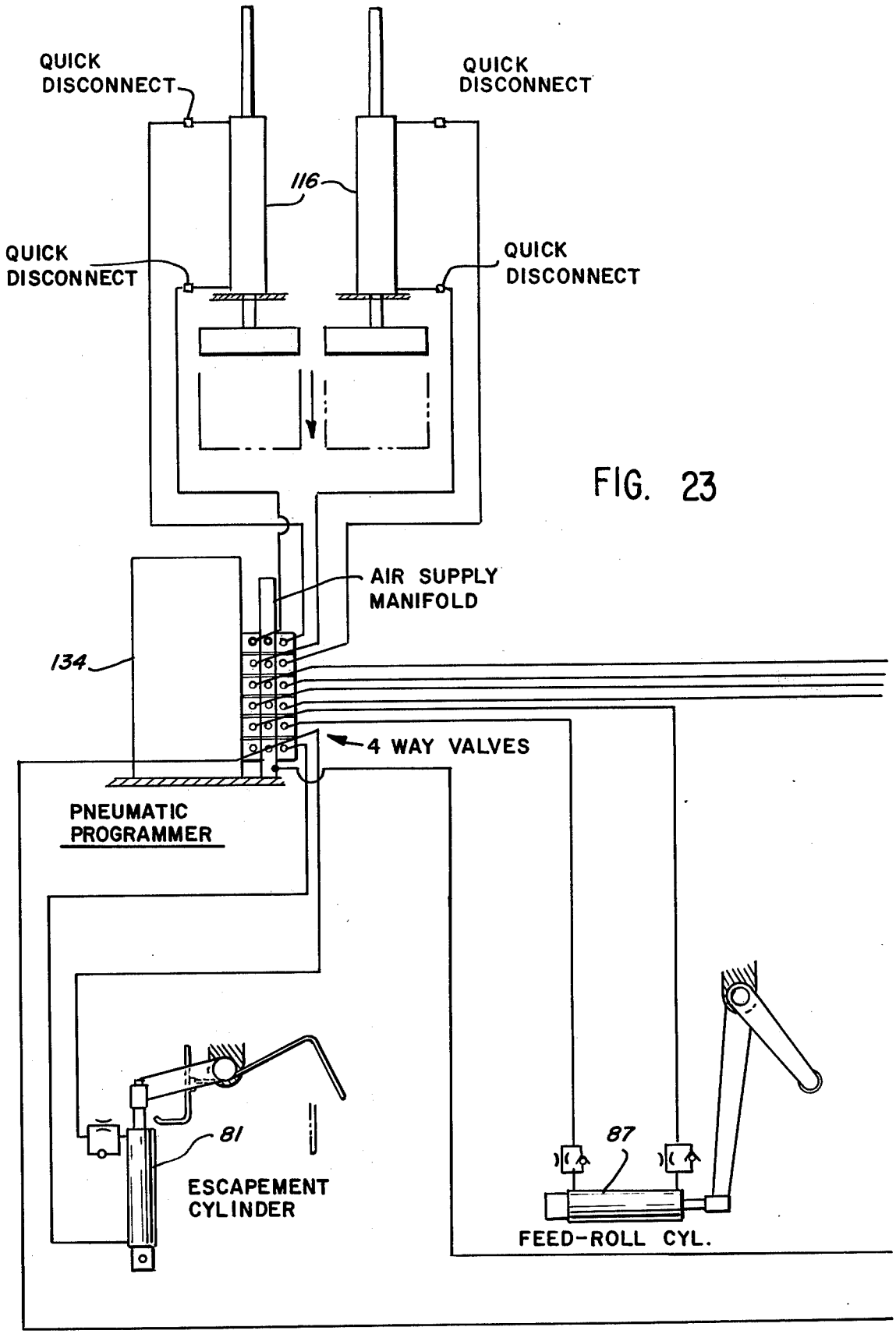
FIG. 23 is a schematic view of the pneumatic actuators of the loader.
Figure 24:
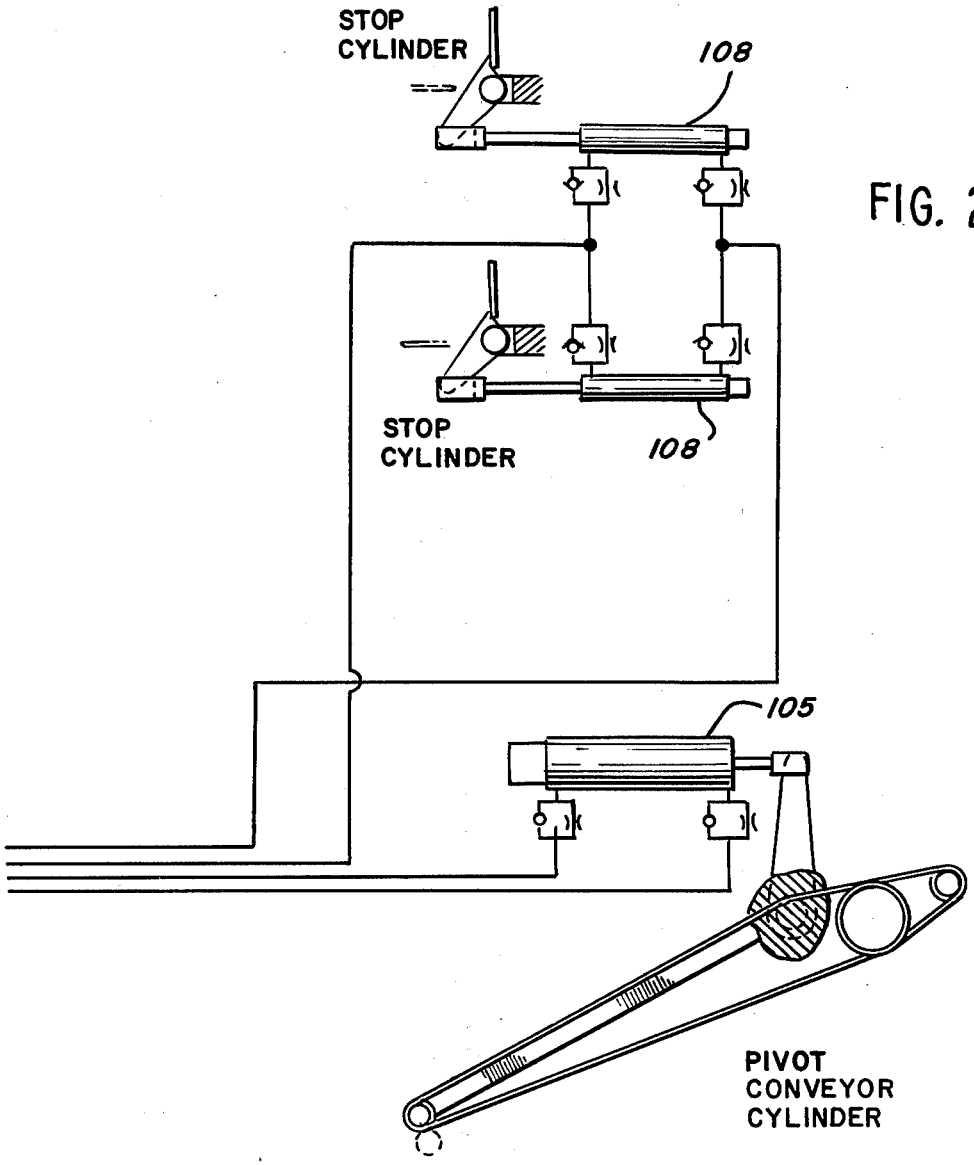
FIG. 24 is a schematic view of the balance of the actuators not shown in FIG. 23.
Figure 25:
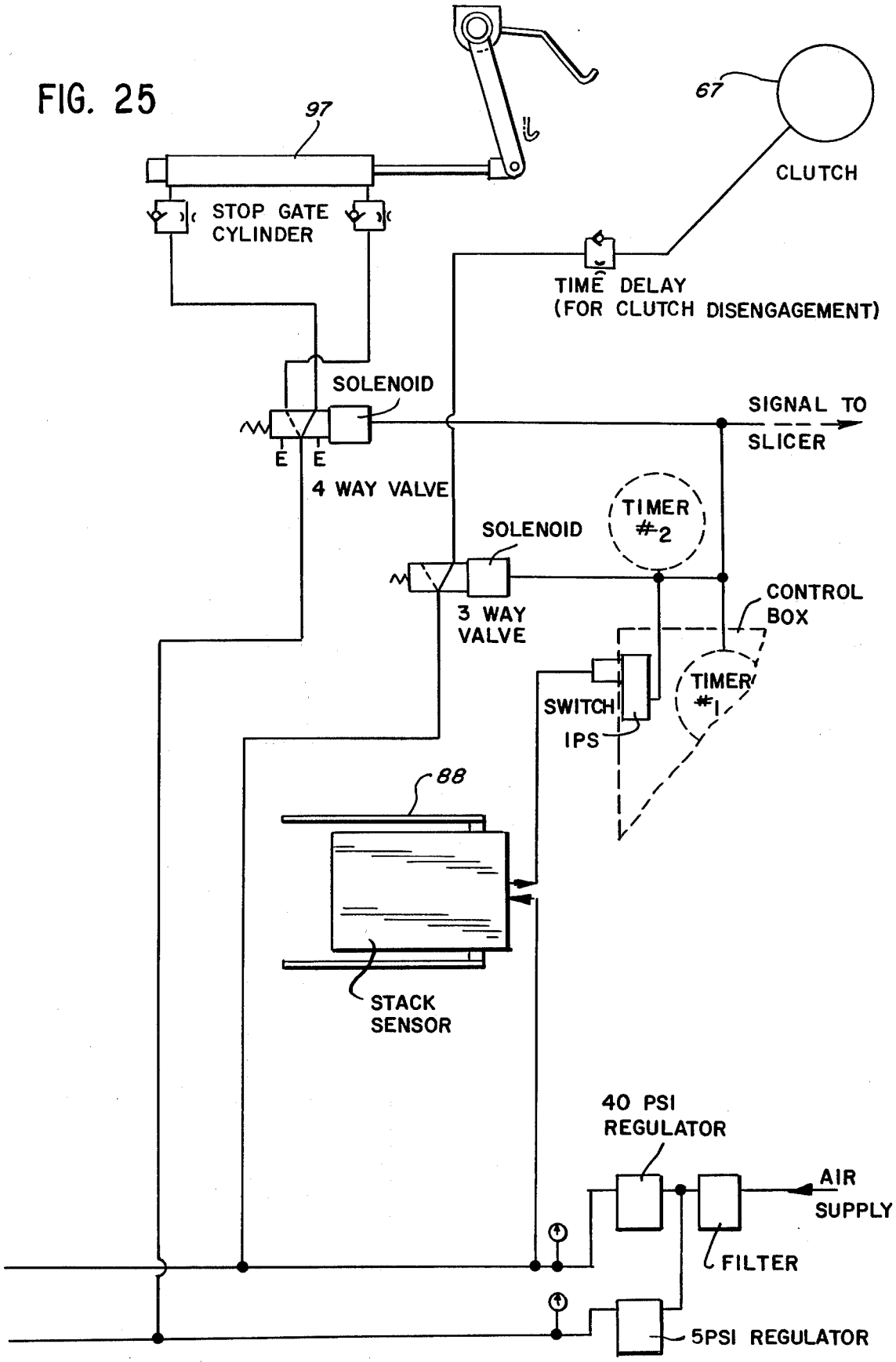
FIG. 25 is a pneumatic diagram of the loader.
Figure 27:
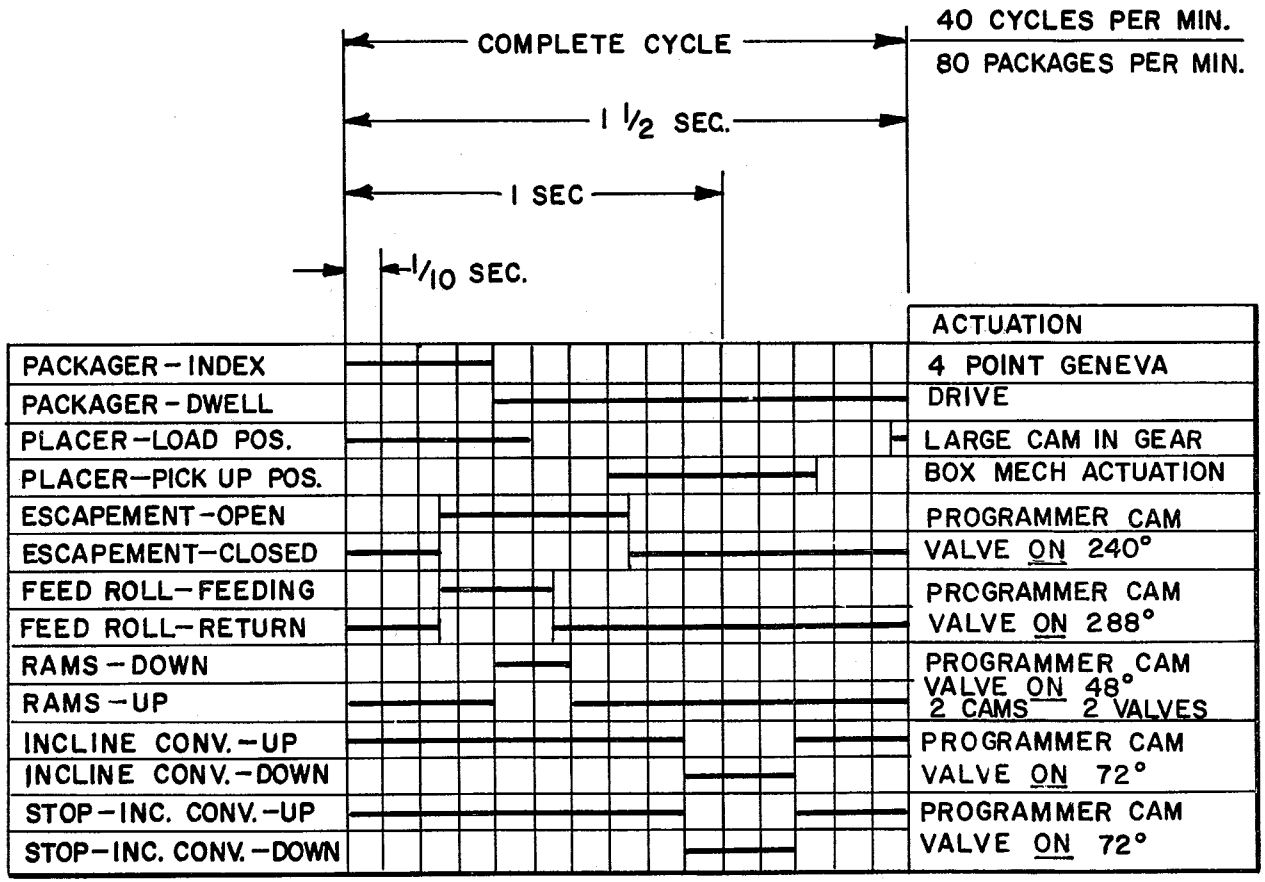
FIG. 27 is a phase diagram of loader operation.

Referring to FIGS. 23 and 24, the pneumatic actuators of the loader are shown but not including the items associated with the pneumatic sensor arrangement which are shown with the balance of the pneumatic circuit on FIG. 25. Air at suitable source pressure is piped to the pneumatic programmer 134 which includes a shaft driven by the transmission which rotates suitable cams that actuate roller equipped 4 way valves which direct air to double acting ram cylinders 116, escapement cylinder 81, feed roll cylinder 87, stop cylinders 108 and inclined conveyor cylinder 105. All of these cylinders are controlled by the pneumatic programmer along with an index and dwell position of the packager (not shown). FIG. 27 shows the timing chart, which is self explanatory for a cycle of operation of the loader.

Referring to FIG. 25, the balance of the circuit and the sensor components are shown. Sensor assembly 88 is shown and is connected to the air source and to pressure switch IPS. Also shown is stop gate cylinder 97 and a 4 way solenoid valve, and air clutch 67 for infeed conveyor 35 with a three way solenoid operated valve. Two time delays are included in the electrical diagram associated therewith in FIG. 25 and which are shown also in the electrical diagram of the loader which is shown best in FIG. 26.

Figure 26:
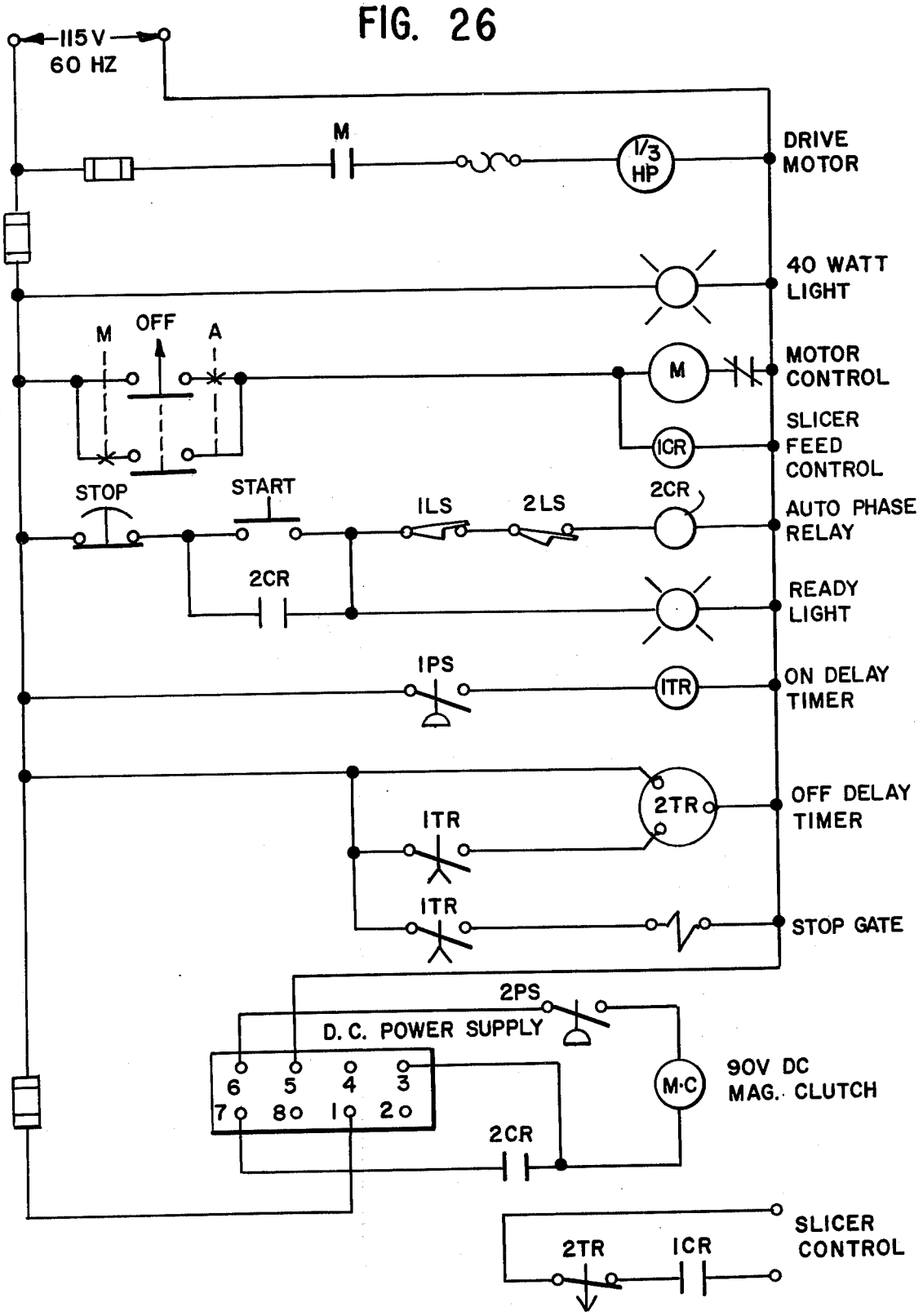
FIG. 26 is an electrical diagram of the loader.

Referring to FIG. 26, the electrical diagram for the loader is shown in detail. With the selector switch in manual, motor (64) is energized and the slicer control contacts 1 CR close. Since driven by motor 64, surge conveyor 36 will run as will infeed conveyor 35 however, subject to pneumatic clutch 67 when the slicer feed is operating. When the push button is depressed for the auto phase cycle, contacts 2 CR close supplying power to the magnetic clutch 126. If the stop push button is pressed or 1 LS limit switch (cycle synchronizer) or 2 LS limit switch are released, 2 CR is de-energized cutting power to clutch 126. Power has to be re-established by pressing the start pushbutton. 2 PS, an air pressure switch, also controls the power to the clutch.

The control of the stack feed from the slicer to the loader is though the sensor assembly 88 through pressure switch 1 PS of FIG. 25 in conjunction with (time delay) 1 TR (On Delay) Timer and 2 TR longer (Off Delay Timer) of FIG. 26. As mentioned if a single stack passes the sensor arms the sensor is tripped for 0.4 seconds with no signal being sent. If the stacks are abutting and stationary, a 1 second timer 1 TR is tripped which closes stop gate 84 and energizes 2 TR (time delay) and opens contacts 2 TR to stop the slicer and also de-energizes clutch 67 of infeed conveyor via the solenoid valve. When the sensors are released the stop gate 84 opens but the off time delay prevents slicer and clutch 67 from starting until the stacks from the gate to the infeed conveyor are clear of the sensor. As the timer runs out the slicer and infeed conveyor clutch are again energized. A time delay in the air clutch circuit (FIG. 25) of the infeed conveyor allows the stacks on the slicer conveyor to transfer to the infeed conveyor. Thus the output of the slicer is controlled to regulate the flow of stacks to the loader for deposit into the cavities of the packager in a continuous operation.

From the discussion of the electrical diagram of FIG. 26 and in view of the pneumatic actuators of FIGS. 24 and 25 and the phase relationships of the various components shown in FIG. 27 of a complete cycle of the loader, it is felt that the operation of the loader is clearly apparent insofar as the pneumatic loading cycle and also the infeed control. Clearly the stops of the infeed conveyor could be loaded by hand, or by an escapement with suitable conveyors with the entire loader however, being adapted for the use of the particular regulatory feed control specified.

We claim:

1. A machine for loading stacks of sliced food obtained from a slicer to a packager comprising:

(a) a transmission adapted to be connected to a source of power;

(b) a placer connected to said transmission for rotation between a lower discharge position to a packager having a cavity and an upper pick up position, said placer having a pair of spring closed doors for support for a stack of sliced food;

(c) a ram mounted for reciprocation on said placer above said doors;

(d) first means for reciprocating said ram to force the stack through said doors into a cavity of the packager;

(e) an inclined slip-torque conveyor rotatably mounted on said transmission and driven by said transmission;

(f) second means for rotating said conveyor;

(g) a stop mounted on said conveyor at its lower end;

(h) third means for moving said stop between an extended and a retracted position;

(i) and valve means driven by said transmission, said valve means actuating said second and third means to rotate said conveyor downward and retract said stop as said placer moves the stack via said doors downwardly toward said load position, where said valve means energizes said first means to ram the stack past the doors into the cavity, said valve means then reversing said first, second and third means prior to repeating the operation.

2. The machine of claim 1 further comprising an escapement located adjacent the end of said conveyor opposite said stop and forth means to pivot said escapement under control of said valve means to release one stack to the conveyor for movement to said stop.

3. The machine of claim 2 further comprising a second slip-torque conveyor for feeding stacks to the escapement.

4. The machine of claim 3 comprising an escapement feed roll drivably connected to said transmission, and fifth means for moving said feed roll to a feeding position under control of said valve means when said escapement releases a stack.

5. The machine of claim 4 further comprising a third conveyor to move stacks from the slicer to the second conveyor.

6. The machine of claim 5 in which said placer has two pairs of laterally spaced doors and a ram for each pair of doors and said inclined conveyor has a pair of stops for receipt of a stack from said escapement for each stop.

7. The machine of claim 5 further comprising control means for regulating the flow of stacks from the slicer to the second conveyor via the third conveyor, said control means comprising: a sensor for contacting the stacks before the escapement; a stop gate for controlling the stack flow to the escapement; sixth means for controlling and moving the stop gate between and open and closed position; a clutch for said third conveyor; seventh means for controlling engaging and disengaging said clutch; a pressure switch and an electrical circuit including a time delay responsive to said pressure switch when the stacks are accumulated and stationary to close the stop gate, disengage the clutch and send a signal to stop the slicer until the time delay times out and the stacks clear the sensor.

8. The machine of claim 7 further comprising a second longer time delay for said control means that prevents operation of the slicer and the engagement of said clutch after the gate has been opened until the stacks from the gate and the third conveyor clear the sensor.

* * * * *